United States Patent [19]

Yokota

[11] 4,182,640

[45] Jan. 8, 1980

[54] ALUMINUM ALLOY ELECTRIC CONDUCTOR WIRE

[75] Inventor: Minoru Yokota, Osaka, Japan

[73] Assignee: Sumitomo Electric Industries, Ltd., Osaka, Japan

[21] Appl. No.: 838,762

[22] Filed: Oct. 3, 1977

Related U.S. Application Data

[63] Continuation-in-part of Ser. No. 663,673, Mar. 4, 1976, abandoned, which is a continuation of Ser. No. 467,220, May 6, 1974, abandoned.

[30] Foreign Application Priority Data

May 17, 1973 [JP] Japan ..... 48-55075

[51] Int. Cl.[2] ..... C22C 21/00

[52] U.S. Cl. ..... 148/32; 75/139; 75/142

[58] Field of Search ..... 75/138, 139, 142, 147; 148/32, 32.5

[56] References Cited

U.S. PATENT DOCUMENTS 3,811,846 5/1974 Schoerner et al. ..... 75/138

*Primary Examiner*—R. Dean

*Attorney, Agent, or Firm*—Carothers and Carothers

[57] ABSTRACT

A heat-resistant high strength aluminum alloy electric conductor wire which is an aluminum alloy consisting essentially of 0.01–0.5% copper, 0.01–0.5% zirconium, 0.05–1.0% iron and the balance of aluminum and impurities with a magnesium content limited not to exceed 0.1%, or an aluminum alloy electric conductor wire consisting of said alloy and one or more elements selected from a group consisting of 0.0005–0.05% yttrium, 0.005–0.5% beryllium, 0.0005–0.3% molybdenum, and 0.01–2.0% calcium.

6 Claims, No Drawings

ALUMINUM ALLOY ELECTRIC CONDUCTOR WIRE

CROSS REFERENCE TO RELATED APPLICATIONS

This is a continuation-in-part of U.S. Pat. application Ser. No. 663,673 filed Mar. 4, 1976, abandoned, which is a continuation of application Ser. No. 467,220 filed May 6, 1974 for Aluminum Alloy For Electric Conductors, which is now abandoned.

BACKGROUND OF THE INVENTION

The present invention relates to an aluminum alloy electric conductor wire, and more particularly to an aluminum alloy electric conductor wire which possesses high strength and excellent heat resistant properties.

Aluminum alloys which have heretofore been in general use for overhead transmission and distribution lines may be roughly divided into high strength aluminum alloys (Alloy 6201, Alloy 5005, "Aldrey"—trademark—Aluminum Alloy, etc.) and heat-resistant aluminum alloys. In the case of the former, the permissible service temperature is 90° C. and their design standards are similar to those for the aluminum conductor steel reinforced (ACSR) conductors in general, while in the case of the latter, the service temperature is as high as 150° C. and the alloys of this type are widely used for electric conductors for large capacity overhead transmission lines in recent times.

That is to say, the high strength aluminum alloys heretofore in general use have a characteristic feature of a high strength (for example, the tensile strength of Alloy 5005 which is an Al-Mg alloy is approximately 25 $Kg/mm^2$ and that of "Aldrey" Aluminum Alloy, which is an Al-Mg-Si alloy, is 31.5 $Kg/mm^2$), but their permissible temperatures are limited to a low point because of their properties, so that they have been unable to meet the need most keenly felt in recent years, i.e., the need for increasing power transmission capacity by raising the service temperature. On the other hand, the heat-resistant aluminum alloys are of ordinary aluminum for electrical purposes to which zirconium has been added in a quantity of about 0.1%. Their tensile strength is about equal to that of hard drawn aluminum used for electrical purposes. Generally, they are put in use with their low strength reinforced by compound stranding it with steel wires.

However, since demand for electrical power has increased remarkably in recent years, the necessity for developing techniques for large capacity transmission of electric power has become greater and greater, and the development of a new aluminum alloy for conductors which has satisfactory combined overall properties of strength, heat resistance and electrical conductivity has come to be desired.

SUMMARY OF THE INVENTION

The aluminum alloy electric conductor wire of the present invention is intended to provide conductor wires which satisfy the aforementioned desire. That is to say, the alloy of the present invention is a heat-resistant, high strength aluminum alloy electric conductor wire, which has a minimum electrical conductivity of 54–55% IACS, which is equal to or more than that of Alloy 5005, or at least 20 $Kg/mm^2$ under hard drawn condition, and a tensile strength of the same level as that of Alloy 5005, and which is guaranteed a permissible long-time service temperature of 150° C.

An object of the present invention is to provide a heat-resistant high strength aluminum alloy electric conductor wire which possesses excellent heat resistant properties for large capacity transmission and distribution of electric power and an excellent strength at the same time.

The present invention relates to a heat-resistant high strength aluminum alloy electric conductor wire which is characterized in that it comprises 0.01–0.5% copper (here and hereinafter % is by weight), 0.01–0.5% zirconium and 0.05–1.0% iron, the balance being aluminum and impurities, and with the further condition that the magnesium content (if any) be limited not to exceed 0.1%.

The reason why the present invention limits the copper content to 0.01–0.5% is that no remarkable improvement in strength is observed if the copper content is less than 0.01%, while a remarkable decrease in electrical conductivity and resistance to corrosion is observed if it exceeds 0.5%.

The reason why the zirconium content is limited to 0.01–0.5% is that it is of little effect in improving resistance to heat if the zirconium content is less than 0.01%, while it lowers electrical conductivity markedly and also impairs casting workability if it exceeds 0.5%.

The reason why the iron content is limited to 0.05–1.0% is that no remarkable effect to improve strength is observed if the iron content is less than 0.05%, while if it exceeds 1.0%, it greatly lowers electrical conductivity and impairs casting workability, although it improves strength.

Another characteristic of the present invention is that the quantity of magnesium which is generally present in aluminum electric conductor wire as an impurity or is intentionally added to such aluminum is limited not to exceed 0.1%. Aluminum alloy electric conductor wires of the high strength type which have been used most commonly up to now are Alloy 6201, "Aldrey" Aluminum Alloy (an Al-Mg-Si alloy) and Alloy 5005 (an Al-Mg alloy). It may be said that many aluminum alloy electric conductor wires have been developed through efforts to find out additive elements for coexistence with this magnesium. It has been said that the addition of magnesium to aluminum not only remarkably improves strength at ordinary temperatures, but also improves creep strength at high temperatures. Much research has been conducted concerning the behavior of Al-Mg alloys at high temperatures. In developing on the basis of these facts a heat-resistant, high strength aluminum alloy excellent in strength, resistance to heat and electrical conductivity, the present inventor added copper, zirconium, iron, etc., to an Al-Mg alloy as the base and investigated their heat resistant properties. As a result, it was found that if magnesium was added to the alloy of the present invention, which is an Al-Cu-Fe-Zr alloy, its heat resistant characteristics were remarkably degraded. In consequence, it was thereby discovered that the presence of magnesium remarkably impaired the heat resistant properties of the alloy of the present invention. With respect to the ordinary Al-Zr-Fe alloys, it has heretofore been maintained that the addition of magnesium greatly improves their heat resistant properties. (For example, see Japanese Patent Publication Toku-Ko-Sho No. 43-6604 specification). In the case of an Al-Cu-Zr-Fe alloy, the alloy of the present invention, however, the presence of magnesium greatly impairs its heat resistant properties, and it is presumed that this is due to a difference in mechanism between the effect on heat resistant properties at the strength level of EC aluminum and the effect on heat resistant properties at the strength level obtainble with the alloy of the present invention. It is desirable that the quantity of magnesium contained in the alloy of the present invention is as small as possible, but the magnesium contained as an impurity element in the ordinary aluminum for electric purposes and such a quantity of magnesium as comes from mother alloys, Al-Cu, Al-Zr, Al-Fe, etc., when manufacturing the alloy of the present invention are permissible. It is desirable that its content does not exceed 0.1%.

It is a well known fact that copper, iron and zirconium have been used in electric conductor wires by addition to aluminum singly or in combinations. However, it is a fact not yet known to others that a heat-resistant high strength aluminum alloy electric conductor wire which is excellent in strength, resistance to heat and electric conductivity can be obtained by having the three elements of copper, iron and zirconium in aluminum and limiting its magnesium content to 0.1% or less, as in the case of the alloy of the present invention.

The heat resistance test of materials for electric conductor wires in recent times is conducted by a method in which evaluation is made by the percentage obtained by dividing tensile strength after heating to a high temperature by tensile strength before heating, i.e., a method which attaches great importance to thermal stability. Even if the strength at ordinary temperatures of a material for electric conductor wires is greatly improved, therefore, it would be meaningless to provide a heat-resistant high strength alloy electric conductor wire if the increased strength is reduced upon heating to the temperature for the heat-resistance test. Thus, it must be said that there are very few additive elements which improve strength when added to aluminum and which bring about an improved strength which is thermally stable. What has been thus discovered on this background is the Al-Cu-Fe-Zr alloy of the present invention, a heat-resistant high strength aluminum alloy electric conductor wire. It has been discovered in particular that it can be given excellent heat resistant properties by limiting its magnesium content to 0.1% or less.

The present invention also relates to a further improvement in the properties of strength, ductility, resistance to heat and electrical conductivity by further adding 0.0005–0.05% yttrium, 0.0005–0.5% beryllium, 0.0005–0.3% molybdenum, or 0.01–2.0% calcium.

Yttrium has the effect of improving resistance to heat at a high strength level without degrading the electrical conductivity much. The reason why the quantity of yttrium contained is limited to 0.0005–0.05% is that the effect of improving resistance to heat is not remarkable if its contained quantity is less than 0.0005%, while a content exceeds 0.05% results in rather reduced heat resistant properties, a decreased electrical conductivity and an unwarranted cost increase.

Beryllium is added in a quantity in the range of 0.0005–0.5% for the purpose of improving electrical conductivity and ductility. If beryllium is added to high purity aluminum, its electrical conductivity is slightly lowered. However, if beryllium is added in a very small quantity to the ordinary pure aluminum for industrial purposes, its electrical conductivity is improved. It is considered that this is because beryllium forms intermetallic compounds which various impurities (Fe, Si, etc.) present as solid solutions in aluminum of an ordinary degree of purity. As a result, beryllium gives the material high electrical conductivity and excellent ductility. Thus, the addition of beryllium has favorable effects. On the other hand, however, it sometimes reduces strength and the heat resistant properties through the formation of compounds with Ce, Fe, Zr, etc., which are the co-existent additive elements in the alloy of the present invention. Thus, it is necessary to determine whether it should be added or not and in what quantity it should be added, depending on the properties desired. The desirable quantity of its addition is in the range of 0.0005–0.5%.

Molybdenum is effective to improve heat resistant properties at a high strength level. The reason why the quantity of molybdenum contained is specified to be 0.0005–0.3% is that no remarkable effect to improve strength and the heat resistant properties is observed if its quantity is less than 0.0005%, while electrical conductivity is remarkably degraded and falls outside of the range allowable for a material for electric conductor wire if its quantity exceeds 0.3%.

The degradation of electrical conductivity caused by the addition of molybdenum is comparatively great, approximately 3.4% IACS, with 0.1% Mo. However, it brings about less degradation than the co-existent additive element zirconium, approximately 4% IACS, and it can bring about an improvement in strength which can scarcely be expected from the addition of zirconium alone. Moreover, this improved strength has a high degree of thermal stability.

Calcium is effective to improve resistance to heat at a high strength level without reducing electrical conductivity. The reason why the calcium content is specified to be 0.01–2.0% is that no effect to improve strength, the heat resistant properties and electrical conductivity is observed if the quantity is less than 0.01%, while it remarkably reduces electrical conductivity and impairs casting workability if the quantity exceeds 2.0%.

Also, in the case wherein yttrium, beryllium, molybdenum or calcium is contained, it is desirable to limit the magnesium content not to exceed 0.1% with the object of retaining good heat resistant properties for the same reason as that mentioned in regard to alloys which do not contain these elements.

The present invention further relates to the aforementioned alloy of the present invention containing copper, zirconium and iron, which is characterized in that it simultaneously contains two or more of the elements selected from the group consisting of 0.0005–0.05% yttrium, 0.0005–0.5% beryllium, 0.0005–0.3% molybdenum, and 0.01–2.0% calcium. As is clear from the effect of the improvement properties possessed by each of the aforementioned elements, it goes without saying that properties of the conductors, such as strength, ductility, the heat resistant properties and electrical conductivity, can be improved by combining two or more of these elements in accordance with the requisite properties of the conductor wire.

To manufacture the alloy of the present invention, casting and fabricating methods similar to those used for the conventional aluminum alloy electric conductor wire will suffice. That is to say, the ordinary aluminum is melted and then subjected to boron treatment to remove titanium and vanadium. After the aluminum for electrical purposes is made in this way, the addition is made of the additive elements, copper, zirconium and iron, or with further addition of yttrium, beryllium, molybdenum, or calcium, in addition to said additive elements. In this case, it is preferable to add the additive elements of the present invention is to the form of a mother alloy containing 1–20%, because many of them are metals of a high melting point. The finished conductor wire may be obtained by subsequent casting, hot working and cold working. It is permissible for the alloy of the present invention to contain various impurities such as Si, Mn, etc., which are contained in ordinary aluminum for electrical purposes. It is also permissible to add to it such a metal as Sb, which is well known as an element which improves the resistance to corrosion of aluminum.

The alloy of the present invention will now be explained with reference to examples.

EXAMPLE 1

The alloy elements being added to boron-treated aluminum for electrical purposes through the use of mother alloys of Al–10% Cu, Al–5% Zr and Al–10% Fe, respectively, the alloys of the various constituents were melted and cast into castings of a 25 mm diameter. After hot-forging them to a diameter of approximately 12 mm, they were cold drawn to a 3.0 mm diameter by a wire drawing mill. The electrical and mechanical properties of the wires thus obtained are as shown in Table 1. What is called residual ratio in that Table is the value obtained by dividing the tensile strength of the sample after heating it at 260° C. for 1 hour by the tensile strength before the heating. The ratio was used as a criterion for the heat resistant properties of the wire. The gage length for measuring elongation was 250 mm.

From Table 1 it can be seen that the first alloy of the present invention has superior overall properties of resistance to heat, strength and electrical conductivity which we have been unable to obtain with alloys heretofore available. The alloy P 1 heretofore available is excellent with respect to strength and electrical conductivity, but has very low heat resistant properties, so that it appears to be unuseable as a heat-resistant high strength aluminum alloy. It is also seen that the alloy P 2 heretofore available has a very low strength, although it has excellent heat resistant properties and electrical conductivity. It is shown that the alloy No. 6 of the present invention contains magnesium in a quantity intentionally increased and it has somewhat lower heat resistant properties than the alloy No. 5, yet its heat resistant properties are still good enough. The alloy No. 8 for comparison contains magnesium in a quantity greater than the permissible quantity. It is there shown that the alloy has markedly degraded properties.

EXAMPLE 2

The alloy elements were added to boron-treated aluminum for electrical purposes through the use of mother alloys of Al–10% Cu, Al–5% Zr, Al–10% Fe, and Al–3% Y, respectively, and the alloys of the various constituents were melted and cast into castings of a 25 mm diameter. After hot-forging them to a diameter of approximately 12 mm, they were cold drawn to a 3.0 mm diameter by a wire drawing mill. The electrical and mechanical properties of the wires obtained are as shown in Table 2. The residual ratio and elongation shown in that Table are the values obtained in the same way as those in Table 1.

TABLE 1

| | No. | Compositions (%, analytic value) Cu | Zr | Fe | Mg | Tensile strength (Kg/mm²) | Elongation (%) | (n = 5)* Electrical conductivity (% IACS) | Residual Ratio (%) |
|---|---|---|---|---|---|---|---|---|---|
| | 1 | 0.1 | 0.04 | 0.16 | — | 21.6 | 2.8 | 59.9 | 82.6 |
| Alloys | 2 | 0.1 | 0.05 | 0.55 | — | 23.4 | 2.9 | 59.0 | 85.2 |
| | 3 | 0.1 | 0.10 | 0.55 | — | 23.6 | 2.7 | 57.5 | 88.1 |
| of this | 4 | 0.25 | 0.04 | 0.55 | — | 25.7 | 2.6 | 57.3 | 80.2 |
| | 5 | 0.25 | 0.08 | 0.55 | — | 25.9 | 2.8 | 56.5 | 83.5 |
| Invention | 6 | 0.25 | 0.08 | 0.55 | 0.03 | 26.0 | 2.4 | 56.0 | 79.5 |
| | 7 | 0.25 | 0.13 | 0.55 | — | 26.2 | 2.7 | 55.1 | 85.6 |
| Alloy for Comparison | 8 | 0.1 | 0.10 | 0.55 | 0.15 | 24.9 | 2.3 | 57.0 | 64.0 |
| Alloys of | P1 | 0.3 | — | 0.14 | 0.15 | 27.0 | 2.6 | 59.4 | 52.6 |
| | P2 | — | 0.10 | 0.13 | — | 18.5 | 2.4 | 58.6 | 90.4 |
| Prior Art | P3 | 1.0 | 0.3 | — | — | 30.6 | 2.0 | 50.2 | 70.4 |

*The mean of values measured on 5 samples.

TABLE 2

| | No. | Compositions (%, analytic value) Cu | Zr | Fe | Y | Mg | Tensile strength (Kg/mm²) | Elongation (%) | (n = 5)* Electrical conductivity (% IACS) | Residual Ratio (%) |
|---|---|---|---|---|---|---|---|---|---|---|
| | 11 | 0.10 | 0.04 | 0.17 | 0.005 | — | 21.5 | 2.7 | 59.8 | 84.6 |
| Alloys | 12 | 0.11 | 0.05 | 0.50 | 0.007 | — | 23.7 | 2.8 | 59.1 | 86.3 |
| | 13 | 0.10 | 0.10 | 0.55 | 0.009 | — | 23.5 | 2.6 | 57.6 | 89.2 |
| of this | 14 | 0.25 | 0.05 | 0.55 | 0.010 | — | 25.4 | 2.8 | 57.6 | 81.3 |
| | 15 | 0.25 | 0.08 | 0.55 | 0.010 | — | 25.8 | 2.6 | 56.5 | 84.6 |
| Invention | 16 | 0.25 | 0.08 | 0.65 | 0.015 | 0.04 | 26.0 | 2.3 | 56.2 | 78.5 |
| | 17 | 0.25 | 0.26 | 0.50 | 0.009 | — | 26.4 | 2.6 | 54.2 | 89.4 |
| Alloy for Comparison | 18 | 0.10 | 0.11 | 0.52 | 0.012 | 0.14 | 25.2 | 2.3 | 56.9 | 64.5 |
| | P1 | 0.30 | — | 0.14 | — | 0.15 | 27.0 | 2.6 | 59.4 | 52.6 |
| Alloys of | P2 | — | 0.10 | 0.13 | — | — | 18.5 | 2.4 | 58.6 | 90.4 |

TABLE 2-continued

| | No. | Compositions (%, analytic value) Cu | Zr | Fe | Y | Mg | Tensile strength (Kg/mm²) | Elongation (%) | (n = 5)* Electrical conductivity (% IACS) | Residual Ratio (%) |
|---|---|---|---|---|---|---|---|---|---|---|
| | P4 | — | 0.10 | 0.13 | 0.009 | — | 18.7 | 2.6 | 58.5 | 91.8 |
| Prior Art | P3 | 1.0 | 0.30 | — | — | — | 30.6 | 2.0 | 50.2 | 70.4 |

*The mean of values measured on 5 samples.

From Table 2 it can be seen that the alloy of the present invention containing yttrium possesses excellent overall properties of resistance to heat, strength and electrical conductivity which have not been obtainable with the conventional alloys. The conventional alloy P 1 has excellent strength and electrical conductivity, but its heat resistant properties are remarkably poor, so that it is apparently unuseable as a heat-resistant high strength aluminum alloy. The conventional alloys P 2 and P 4 are excellent in heat resistant properties and electrical conductivity, but it is noted that their strength is exceedingly low. Here the alloy No. 16 of the present invention contains magnesium in a quantity increased intentionally. Although its heat resistant properties are a little less than that of the alloy No. 15, it was still found to be good enough. The alloy No. 18 for comparison contains magnesium in a quantity increased beyond the range of permissibility and it is shown that remarkable degradation of heat resistant properties occurs in this case.

EXAMPLE 3

The alloy elements were added to boron-treated aluminum for electrical purposes through the use of mother alloys of Al-10% Cu, Al-5%, Zr, Al-10% Fe and Al-5% Be, respectively, and the alloys of various constituents were melted and cast into castings of a 25 mm diameter. After hot-forging them to a diameter of approximately 12 mm, they were cold drawn to a 3.0 mm diameter by a wire drawing mill. The electrical and mechanical properties of the wires obtained are as shown in Table 3. The residual ratio and elongation shown in that Table are the values obtained in the same way as those in Table 1.

From Table 3, it is seen that the alloy of the present invention containing beryllium possesses such excellent overall properties of resistance to heat, strength and electrical conductivity as have never been obtainable with the alloys heretofore in use. The conventional alloy P 1 is excellent in strength and electrical conductivity but is of remarkably low heat resistant properties, so that it is apparently unuseable as a heat-resistant high strength aluminum alloy. The conventional alloys P 2 and P 5 are excellent in heat resistant properties and electrical conductivity, but it is seen that their strength is very low. The alloy No. 26 of the present invention contains magnesium in a quantity increased intentionally and has slightly lower heat resistant properties than the alloy No. 25. However, its heat resistant properties are still good enough. The alloy No. 28 for comparison contains magnesium in a quantity beyond the permissible range. It is shown that remarkable deterioration of the heat resistant properties is observed.

EXAMPLE 4

The alloy elements are added to boron-treated aluminum for electrical purposes through the use of mother alloys of Al-10% Cu, Al-5% Zr, Al-10% Fe and Al-1% Mo, respectively, and the alloys of various constituents were melted and cast into castings of a 25 mm diameter. After hot-forging them to a diameter of approximately 12 mm, they were cold drawn to a 3.0 mm diameter by a wire drawing mill. The electrical and mechanical properties of the wires obtained are as shown in Table 4. The residual ratio and elongation shown in that Table are values obtained in the same way as those in Table 1.

TABLE 3

| | No. | Compositions (%, analytic value) Cu | Zr | Fe | Be | Mg | Tensile strength (Kg/mm²) | Elongation (%) | (n = 5)* Electrical conductivity (% IACS) | Residual Ratio (%) |
|---|---|---|---|---|---|---|---|---|---|---|
| | 21 | 0.10 | 0.05 | 0.17 | 0.005 | — | 21.2 | 2.9 | 60.0 | 82.4 |
| Alloys | 22 | 0.10 | 0.05 | 0.45 | 0.05 | — | 23.2 | 3.0 | 59.3 | 85.4 |
| | 23 | 0.10 | 0.11 | 0.50 | 0.05 | — | 23.0 | 3.1 | 57.9 | 88.3 |
| of this | 24 | 0.26 | 0.04 | 0.55 | 0.1 | — | 25.0 | 3.2 | 57.6 | 81.0 |
| | 25 | 0.25 | 0.08 | 0.55 | 0.07 | — | 25.1 | 2.9 | 56.8 | 83.2 |
| Invention | 26 | 0.25 | 0.09 | 0.50 | 0.06 | 0.03 | 26.1 | 2.8 | 56.2 | 78.9 |
| | 27 | 0.24 | 0.13 | 0.55 | 0.2 | — | 25.6 | 2.9 | 55.9 | 85.3 |
| Alloy for Comparison | 28 | 0.10 | 0.10 | 0.50 | 0.1 | 0.13 | 25.0 | 2.6 | 57.3 | 62.6 |
| | P1 | 0.30 | — | 0.14 | — | 0.15 | 27.0 | 2.6 | 59.4 | 57.6 |
| Alloys of | P2 | — | 0.10 | 0.13 | — | — | 18.5 | 2.4 | 58.6 | 90.4 |
| | P5 | — | 0.10 | 0.13 | 0.05 | — | 17.9 | 3.1 | 59.0 | 91.2 |
| Prior Art | P3 | 1.0 | 0.3 | — | — | — | 30.0 | 2.0 | 50.2 | 70.4 |

*The mean of values measured on 5 samples.

TABLE 4

| | No. | Compositions (%, analytic value) Cu | Zr | Fe | Mo | Mg | Tensile strength (Kg/mm²) | Elongation (%) | (n = 5)* Electrical conductivity (% IACS) | Residual Ratio (%) |
|---|---|---|---|---|---|---|---|---|---|---|
| | 31 | 0.10 | 0.05 | 0.18 | 0.002 | — | 21.5 | 2.8 | 59.3 | 83.2 |
| Alloys | 32 | 0.11 | 0.04 | 0.50 | 0.008 | — | 23.6 | 2.9 | 58.4 | 86.4 |
| | 33 | 0.10 | 0.11 | 0.50 | 0.02 | — | 24.0 | 2.5 | 56.9 | 89.2 |
| of this | 34 | 0.26 | 0.05 | 0.55 | 0.04 | — | 26.1 | 2.4 | 56.0 | 81.3 |
| | 35 | 0.25 | 0.08 | 0.53 | 0.05 | — | 26.3 | 2.4 | 54.5 | 83.9 |
| Invention | 36 | 0.25 | 0.09 | 0.50 | 0.05 | 0.03 | 26.8 | 2.2 | 54.0 | 80.0 |
| | 37 | 0.24 | 0.03 | 0.55 | 0.19 | — | 27.0 | 2.7 | 53.9 | 86.3 |
| Alloy for | | | | | | | | | | |
| Comparison | 38 | 0.10 | 0.10 | 0.50 | 0.02 | 0.14 | 25.1 | 2.2 | 56.1 | 66.0 |
| Alloys of | P1 | 0.3 | — | 0.14 | — | 0.15 | 27.0 | 2.6 | 59.4 | 57.6 |
| | P2 | — | 0.10 | 0.13 | — | — | 18.5 | 2.4 | 58.6 | 90.4 |
| Prior Art | P3 | 1.0 | 0.30 | — | — | — | 30.6 | 2.0 | 50.2 | 70.4 |

*The mean of values measured on 5 samples.

From Table 4 it can be seen that the alloy of the present invention containing molybdenum has excellent overall properties of resistance to heat, strength and electrical conductivity which have never been obtained with conventional alloys. The conventional alloy P 1 is excellent in strength and electrical conductivity, but has remarkably low heat resistant properties, so that it is evidently unuseable as a heat-resistant high strength alloy. The conventional alloy P 2 is excellent in heat resistant properties and electrical conductivity, but has a very low strength. The alloy No. 36 of the present invention contains magnesium in a quantity increased intentionally and i] rteerefore has slightly less heat resistant properties than the alloy No. 35, but its heat resistant properties are still good enough. The alloy No. 38 for comparison contains magnesium in a quantity increased beyond the permissible range and shows remarkable degradation of heat resistant properties.

EXAMPLE 5

The alloy elements were added to boron-treated aluminum for electrical purposes through the use of mother alloys of Al-10% Cu, Al-5% Zr, Al-10% Fe and Al-10% Ca, respectively, and the alloys of various constituents were melted and cast into castings of a 25 mm diameter. After hot-forging them to a diameter of approximately 12 mm, they were cold drawn to a 3.0 mm diameter by a wire drawing mill. The electrical and mechanical properties of the wires obtained are as shown in Table 5. The residual ratio and elongation shown in that Table are values obtained in the same way as those in Table 1.

TABLE 5

| | No. | Composition (%, analytic value) Cu | Zr | Fe | Ca | Mg | Tensile strength (Kg/mm²) | Elongation (%) | (n = 5)* Electrical conductivity (% IACS) | Residual Ratio (%) |
|---|---|---|---|---|---|---|---|---|---|---|
| | 41 | 0.10 | 0.04 | 0.17 | 0.04 | — | 21.8 | 2.9 | 59.9 | 83.5 |
| Alloys | 42 | 0.11 | 0.04 | 0.52 | 0.03 | — | 23.6 | 2.8 | 59.1 | 86.3 |
| | 43 | 0.10 | 0.11 | 0.56 | 0.1 | — | 23.8 | 2.6 | 57.8 | 88.9 |
| of this | 44 | 0.25 | 0.04 | 0.54 | 0.04 | — | 25.7 | 2.4 | 57.6 | 81.4 |
| | 45 | 0.24 | 0.09 | 0.55 | 0.15 | — | 26.2 | 2.6 | 56.7 | 84.2 |
| Invention | 46 | 0.26 | 0.09 | 0.55 | 0.15 | 0.03 | 26.3 | 2.6 | 56.1 | 79.2 |
| | 47 | 0.25 | 0.14 | 0.50 | 0.90 | — | 27.4 | 2.4 | 55.3 | 84.3 |
| Alloys for | 48 | 0.10 | 0.10 | 0.55 | 0.1 | 0.13 | 24.9 | 2.6 | 57.2 | 63.6 |
| Comparison | 49 | 0.25 | 0.04 | 0.55 | 0.04 | 0.14 | 26.2 | 2.6 | 57.3 | 62.5 |
| | P1 | 0.30 | — | 0.14 | — | 0.15 | 27.0 | 2.6 | 59.4 | 52.6 |
| Alloys of | P2 | — | 0.10 | 0.13 | — | — | 18.5 | 2.4 | 58.6 | 90.4 |
| | P6 | — | 0.10 | 0.14 | 0.3 | — | 18.3 | 2.6 | 58.8 | 92.3 |
| Prior Art | P3 | 1.0 | 0.3 | — | — | — | 30.6 | 2.0 | 50.2 | 70.4 |

*The mean of values measured on 5 samples.

From Table 5 it is seen that the alloy of the present invention containing calcium has excellent overall properties of resistance to heat, strength and electrical conductivity. The conventional alloy P 2 is excellent in strength and electrical conductivity, but its heat resistant properties are remarkably low, so that it is apparently unuseable as a heat-resistant high strength aluminum alloy. The conventional alloys P 2 and P 6 are excellent in their heat resistant properties and electrical conductivity, but it is noted that its strength is very low. The alloy No. 46 of the present invention contains magnesium in a quantity intentionally increased. Though its heat resistant properties are a little lower than those of the alloy No. 45, it is noted that it is still good enough for use. The alloys Nos. 48 and 49 are comparison contain magnesium in a quantity increased beyond the permissible range. It is noted that their heat resistant properties are remarkably low.

From the aforementioned examples and the results of their study, it is seen that the present invention provides heat-resistant high strength aluminum electric conductor wire which has excellent heat resistant properties and improved strength (at least 20 Kg/mm² under hard drawn condition) at the same time, and which has an exceedingly great value for industrial use as conductor wire for large capacity overhead transmission and distribution lines in the future.

I claim:

1. An aluminum alloy electric conductor wire comprising a wire having excellent heat-resistant properties and consisting essentially of 0.01–0.5% copper, 0.01–0.5% Zirconium, 0.05–1.0% iron and a balance of aluminum and impurities, having a magnesium content of 0.1% at the most, and having excellent heat-resistance properties and a minimum tensile strength of 20 $Kg/mm^2$ under hard-drawn condition, said conductor wire being in a state of hard-drawn condition.

2. The aluminum alloy electric conductor wire as claimed in claim 1 which contains 0.0005–0.05% yttrium.

3. The aluminum alloy electric conductor wire as claimed in claim 1 which contains 0.0005–0.5% beryllium.

4. The aluminum alloy electric conductor wire as claimed in claim 1 which contains 0.0005–0.3% molybdenum.

5. The aluminum alloy electric conductor wire as claimed in claim 1 which contains 0.01–2.0% calcium.

6. An aluminum alloy electric conductor wire as claimed in claim 1 which contains two or more elements selected from a group consisting of 0.0005–0.05% yttrium, 0.0005–0.5% beryllium, 0.0005–0.3% molybdenum, and 0.01–2.0% calcium.

* * * * *